United States Patent [19]

Rahill

[11] Patent Number: 4,621,774

[45] Date of Patent: Nov. 11, 1986

[54] PULVERIZER FOR CREMATED REMAINS

[75] Inventor: Paul F. Rahill, Longwood, Fla.

[73] Assignee: Industrial Equipment & Engineering Co., Orlando, Fla.

[21] Appl. No.: 672,584

[22] Filed: Nov. 16, 1984

Related U.S. Application Data

[63] Continuation-in-part of Ser. No. 543,356, Oct. 19, 1983, abandoned.

[51] Int. Cl.[4] ..... B02C 19/12

[52] U.S. Cl. ..... 241/84.2; 241/84.3; 241/89.3; 241/95; 241/100

[58] Field of Search ..... 241/100, 283, 264–269, 241/228, 89.3, 69, 73, 84.2, 84.3, 89.4, 95

[56] References Cited

U.S. PATENT DOCUMENTS

| | | | |
|---|---|---|---|
| 972,515 | 10/1910 | Devlin | 241/84.2 |
| 2,176,552 | 10/1939 | Vocaturo | 241/84.3 |
| 2,305,251 | 12/1942 | Haise | 241/84.2 |
| 2,595,469 | 5/1952 | Konrath | 241/84.2 |
| 3,210,017 | 10/1965 | Nordell | 241/268 X |
| 4,201,347 | 5/1980 | Elkin | 241/100 X |

*Primary Examiner*—Mark Rosenbaum

*Attorney, Agent, or Firm*—Macdonald J. Wiggins

[57] ABSTRACT

A pulverizer for reducing cremated remains having a horizontally mounted fixed cylindrical drum having a top opening and a plurality of perforations over a lower sector of the drum. A free cylindrical reducing bar is disposed parallel to the axis of the drum over the perforate sector. A reciprocating drive shaft, driven from an electric motor, is mounted concentrically within the drum having a yoke assembly driven therefrom which engages the reducing bar for rolling the bar reciprocally over the perforations. Ashes deposited through the top opening are reduced and thereafter pass through the perforations for collection in a drawer. Clearance is provided between the yoke assembly and the reducing bar to permit the bar to pass over noncrushable matter mixed in with the ashes.

1 Claim, 3 Drawing Figures

PULVERIZER FOR CREMATED REMAINS

This Application is a continuation-in-part of co-pending Ser. No. 543,356 filed Oct. 19, 1983; now abandoned.

BACKGROUND OF THE INVENTION

1. Field of the Invention

The present invention relates generally to apparatus for pulverising cremated remains and more particularly to apparatus for reducing the remains to uniform size.

2. Description of the Prior Art

Many crematoriums have used ball mills and the like for grinding ashes to obtain a reduction of size. However, specialized devices have also been built for this purpose. For example, in U.S. Pat. No. 3,837,301 to Faelling, a ball mill is shown having a perforated drum into which an ash pan from the crematory oven is placed and which spills the ashes into the drum when rotated. A number of rolling balls are included which grind the remains as the drum rotates. The ashes sift through the perforations and are collected in an urn. The size of such a drum requires a relatively large structure with a heavy duty motor for driving the drum. In U.S. Pat. No. 4,060,204 to Williford, a hollow perforate drum is provided which rotates, carrying a plurality of elongate rods of various diameters such that the rods tumble one over the other within a pair of flanges for reducing the ashes. The reduced ashes sift through the perforations in the drum and are collected. The necessity for rotating a drum having high inertia requires a large motor, and the tumbling operation results in a high noise level.

Elkin, in U.S. Pat. No. 4,201,347 addresses the problem of metallic, noncrushable matter often unavoidably mixed with remains. He teaches a rotatable grinding plate with a heavy stationary bearing plate positioned over the grinding plate. Although an improvement over other devices, the Elkin machine requires a relatively large and expensive structure and is inconvenient to use.

It is known to use a stationary perforated sector of a cylinder for comminuting wide varieties of materials. For example, sifters, strainers, mashers and the like are common in food preparation. See U.S. Pat. Nos. 972,515; 2,305,251 and 2,595,469. Each of these patents teaches a stationary perforated surface over which a roller is manually passed to perform various functions. In all instances, the roller is rigidly attached to a handle. A powered device of this type is disclosed in U.S. Pat. No. 3,210,017 to Nordell. A roller is attached to an arm and driven from an external power source in a reciprocating motion. This type of device is not suitable for reducing cremated remains due to the problem of jamming when noncrushable material is encountered.

Thus, there is a previously unfilled need for a simple, low cost pulverizer for cremated remains which will reduce ashes which contain noncrushable material without jamming and which is dust free during operation.

SUMMARY OF THE INVENTION

The present invention is a relatively small, compact pulveriser for crematorium remains which does not require the use of a revolving drum and may be operated by a relatively small motor. By eliminating a revolving drum with tumbling rods or balls, exceptionally quiet operation has been ahieved. Basically, the apparatus utilizes a horizontally mounted fixed cylindrical drum, having an opening at the top thereof, connected to a hopper for introducing the remains. A lower sector of the drum is perforated with holes selected in accordance with the ash size desired.

A single cylindrical steel reducing bar, having a diameter of about 3 inches and a length slightly shorter than the length of the drum, is disposed with its axis parallel to the axis of the drum and in contact with the perforate portion of the drum. A shaft is provided through the closed drum ends and is concentric with the drum. A yoke device is attached to the shaft, having the yoke portion partially encircling and captivating the cylindrical steel bar. A clearance of about $\frac{3}{4}$ to 1 inch is provided between the yoke and the reducing bar.

The shaft has, at one end, a crank mechanism driven by a crank arm from a reciprocating motor drive. The reciprocating drive causes the shaft to rotate over an arc slightly greater than the perforate section of the drum. As the shaft thus reciprocates, the yoke carries the cylindrical reducing bar back and forth over the perforate section on the drum. It will be understood that the bar will operate as a roller and rotate as it is moved over the interior of the drum. The clearance between the yoke and the bar permits the bar to jump or roll over any noncrushable material without jamming.

To use the pulveriser of the present invention, the remains are placed in the drum through the opening into the hopper section and a cover placed over the opening. The motor is started, preferably controlled by a timer. As the cylindrical reducing bar is rolled back and forth over the ashes, it grinds the particles into sufficiently small sizes so as to pass through the perforations in the bottom of the drum. As the ashes fall, they are directed by a funnel arrangement into a drawer. After operating for a selected length of time, the motor is turned off, and the drawer removed for disposal of the ashes.

A tight fitting cover is provided for the drum opening and the drawer includes a tight fitting front thereof such that no dust can escape from the pulveriser during use.

It is therefore a principle object of the invention to provide an improved pulveriser for reducing cremated remains which is compact and can be produced at low cost.

It is another object of the invention to provide a pulveriser apparatus which is compact and quiet in operation.

It is still another object of the invention to provide a pulveriser for cremated remains having a non-rotatable drum and utilizing a reciprocating roller for pulverising and adapted to be jam proof.

It is yet another object of the invention to provide a pulveriser for crematory remains which may be driven by a relatively small motor, utilizing a reciprocating drive system.

These and other objects and advantages of the invention will become apparent from the following detailed description when read in conjunction with the drawings.

DETAILED DESCRIPTION OF THE PREFERRED EMBODIMENT

Figure 1:
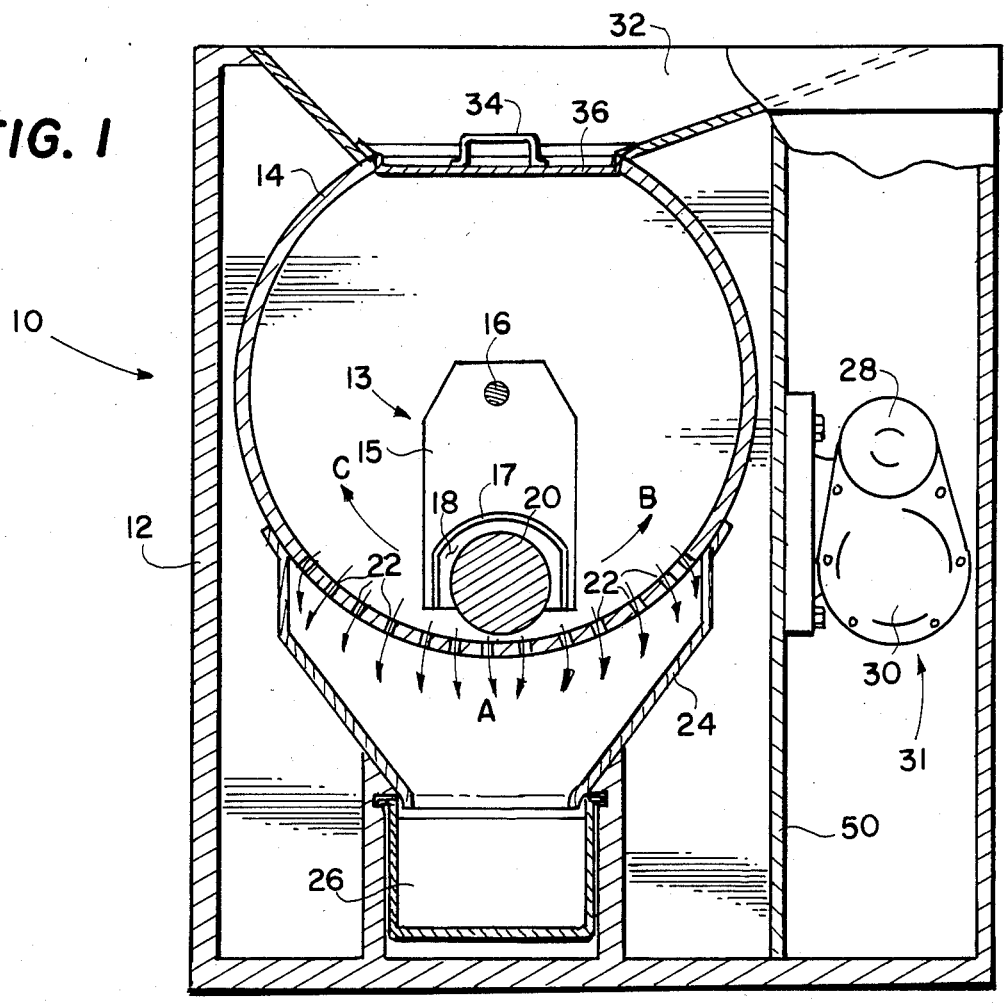
FIG. 1 is a cross sectional view of the pulveriser apparatus of the invention.

Referring first to FIG. 1, a cross sectional view of the preferred embodiment of the crematory remains processor 10 is shown. An outer cabinet 12 is provided having an inner housing 50 which may be formed from sheet steel or the like. A steel cylinder 14 is horizontally disposed in housing 50 and may be on the order of 12 inches in diameter and have a length of 18 to 20 inches. Housing 50 encloses each end of cylinder 14 to form a drum. A shaft 16 extends through drum 14 and is concentric therewith, riding in end bearings not shown in FIG. 1.

A sector of drum 14 along the bottom thereof is perforated by openings 22 with the arc of the sector being on the order of 90°. The perforations 22 are provided for the length of the cylinder over the selected sector thereof.

A cylindrical reducing bar 20 of about three inches in diameter is provided and disposed having its axis parallel to shaft 16 and in contact with the perforate sector of drum 14. The length of bar 20 is approximately the length of cylinder 14, with sufficient clearance at each end to permit it to roll along the perforate sector.

Figure 3:
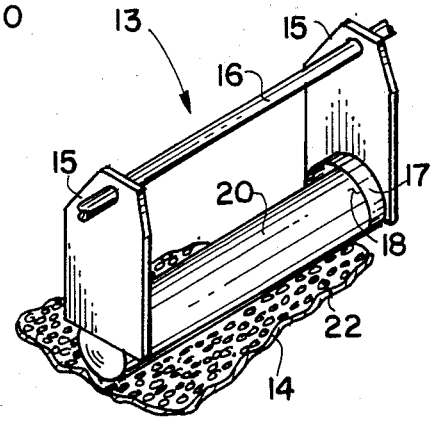
FIG. 3 is a perspective view of the reducing bar and yoke assembly of the invention.

Reducing bar 20 is moved by yoke assembly 13 which is best seen in FIG. 3 and includes a pair of end plates 15 attached to shaft 16. Each plate has a bar captivating yoke 17 attached thereto. As may be noted, yokes 17 straddle the ends of reducing bar 20. Clearance 18 is provided between each yoke 17 and bar 20, and may be on the order of $\frac{3}{4}$ to one inch.

Figure 2:
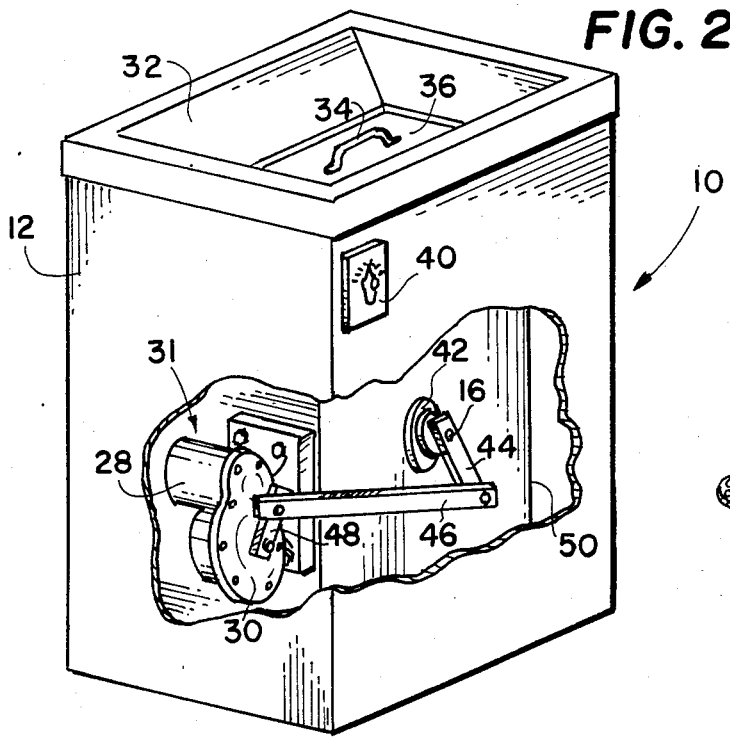
FIG. 2 is a partially cut-away view of the apparatus showing the connection between the motor drive and the shaft.

As best seen in the cut-away view of pulverising apparatus 10 in FIG. 2, shaft 16 is supported in a bearing assembly 42 on each side of housing 50. A crank arm 44 is attached to shaft 16 and, via link arm 46, to crank arm 48 on motor drive assembly 31. Motor drive assembly 31 includes electric motor 28, and gear reduction and reciprocating mechanism 30. Motor drive assembly 31 is controlled by timer 40. When in operation, crank arm 48 reciprocates, causing arm 44 to reciprocate This results in yoke assembly 13 of FIG. 1 rotating alternately in the direction shown by arrow B and then in the direction shown by arrow C over a sufficient arc so as to encompass all of the openings 22. Preferably, the rate of oscillation is about 27 cycles per minute. As will be understood, the reciprocation of yokes 17 will carry reducing bar 20 back and forth over openings 22.

In operation, dust cover 36 is removed from the bottom of hopper 32, permitting access to the opening in the top of cylinder 13, and the remains from the crematorium poured through hopper 32 into drum 14. Dust cover 36 is then replaced and tightly fits into the hopper opening into drum 14 to prevent escape of dust from drum 14. Timer 40 is set for the desired cycling time, and reducing roller 20 is moved back and forth over the remains against the edges of perforations 22. This results in reduction of the ash size until the size is such that the reduced ashes will pass through openings 22 as indicated by arrows A. A sliding drawer 26 is provided at the base of cabinet 12, and the ashes are collected in drawer 26 via funnel 24.

Unavoidably, remains may include non-crushable items such as nails, staples, buttons, denture implants and the like. Advantageously, when reducing bar 20 encounters such material, it will roll over or jump over the material without jamming. Additionally, it has been found that such material tends to move toward the sides of the drum.

When the operation is complete, motor 28 is stopped and drawer 26 may then be removed.

Since drum 14 is stationary and reducing roller or bar 20 is captivated and not permitted to tumble as in conventional processors, the operation of the invention is relatively quiet. It will be understood that the perforations 22 may be selected in accordance with the ash size.

Although the preferred embodiment of the invention has been described in detail herein, it will be obvious to those of skill in the art to make numerous changes and modifications therein without departing from the spirit or scope of the invention.

I claim:

1. A pulveriser for cremated remains having non-reducible matter contained therewith comprising:

a horizontally mounted cylindrical drum having a closable top opening therein and a plurality of perforations over a lower sector thereof, said closable top opening being closed by a dust proof cover removable disposed in said top opening;

a free cylindrical reducing bar disposed within said drum and parallel to the axis of said drum along said lower section;

a drive shaft operatively disposed within and concentric with said drum;

a yoke connected to said drive shaft for engaging and captivating said free reducing bar, and having clearance between said yoke and said reducing bar for permitting said reducing bar to move vertically in said yoke means;

motor operated reciprocating drive means connected to said drive shaft for moving said yoke means in a reciprocating motion over said perforations in said lower sector thereby causing said free reducing bar to roll over said perforations; and a removable drawer disposed beneath said perforate sector of said drum for receiving reduced remains, said drawer and said cover including means for prevention of escape of dust during reduction of remains.

* * * * *